US005216197A

United States Patent [19]

Huber et al.

[11] Patent Number: 5,216,197

[45] Date of Patent: Jun. 1, 1993

[54] EXPLOSIVE DIODE TRANSFER SYSTEM FOR A MODULAR PERFORATING APPARATUS

[75] Inventors: Klaus B. Huber, Sugar Land; Antoni K. L. Miszewski, Missouri City, both of Tex.

[73] Assignee: Schlumberger Technology Corporation, Houston, Tex.

[21] Appl. No.: 718,494

[22] Filed: Jun. 19, 1991

[51] Int. Cl.[5] ..... F42B 3/00

[52] U.S. Cl. ..... 102/317; 102/313; 102/275.2; 102/275.7

[58] Field of Search ..... 313/298; 102/312, 313, 102/202.1, 275.275.3, 275.4, 275.7, 317

[56] References Cited

U.S. PATENT DOCUMENTS

| | | | |
|---|---|---|---|
| 2,857,845 | 10/1958 | Seavey et al. | 102/202.7 X |
| 3,351,016 | 11/1967 | Simpson | 102/202.2 X |
| 4,208,966 | 6/1980 | Hart | 102/202.2 X |
| 4,395,950 | 8/1983 | Oswald | 102/200 |
| 4,635,554 | 1/1987 | Palmer | 102/416 |
| 4,762,067 | 8/1988 | Barker et al. | 102/313 |
| 4,850,438 | 7/1989 | Regalbuto | 175/4.56 |
| 5,105,742 | 4/1992 | Sumner | 102/312 |

*Primary Examiner*—Peter A. Nelson

*Attorney, Agent, or Firm*—Henry N. Garrana; John H. Bouchard

[57] ABSTRACT

An explosive diode transfer system is interconnected between adjacent perforating guns of a modular perforating apparatus. The explosive diode transfer system includes a downwardly directed shaped charge, a booster, and a multi-density barrier interposed between the shaped charge and the booster. The multi-density barrier includes a first metal layer and a second metal layer spaced from the first metal layer thereby defining a sealed air-space between the first and second metal layers. The first metal layer, air space, second metal layer combination represents a plurality of different density barriers or layers which are collectively designed to prevent a first detonation wave, propagating from the booster to the shaped charge, from propagating therethrough, but nevertheless to allow a jet, propagating from the shaped charge to the booster, to propagate therethrough. The multi-density character of the barrier and the air space reflect and therefore completely attenuate the first detonation wave as it propagates from the booster to the shaped charge, but does not significantly attenuate the jet propagating from the shaped charge to the booster. Therefore, the explosive diode transfer system functions like a diode, allowing propagation in one direction, but not allowing propagation in the opposite direction. Consequently, the multi-density barrier of the explosive diode transfer system prevents a back fired detonation wave originating from a lower oriented perforating gun from detonating a higher oriented perforating gun in the modular perforating apparatus.

7 Claims, 4 Drawing Sheets

EXPLOSIVE DIODE TRANSFER SYSTEM FOR A MODULAR PERFORATING APPARATUS

BACKGROUND OF THE INVENTION

The subject matter of the present invention relates to an apparatus for preventing a back fired detonation wave from propagating through a detonating cord, and more particularly, to an explosive diode transfer system for use in a modular perforating apparatus for preventing a back fired detonation wave originating from a lower oriented gun of the modular perforating apparatus from detonating a higher oriented gun in the perforating apparatus.

In a modular perforating apparatus, a plurality of perforating guns are serially connected together including a first, higher oriented perforating gun, a second, lower-oriented perforating gun connected to the first perforating gun and located below the first perforating gun when disposed in a borehole, and possibly additional perforating guns connected to the second perforating gun and located below the second perforating gun when disposed in a borehole. Normally, one firing head is located at the top of the gun string, a detonation of the firing head serially detonating the perforating guns of the modular perforating apparatus starting with the first higher oriented perforating gun. For safety reasons, the one firing head is connected to the top of the gun string after the modular perforating apparatus has been lowered into the borehole; and, following detonation of the perforating apparatus, the firing head is the first to be removed. However, if the firing head fails to detonate, the perforating apparatus disposed in the borehole is not detonated. Therefore, in order to improve the reliability of the modular perforating apparatus, a firing head is associated with each perforating gun of the modular perforating apparatus. As a result, if the firing head associated with the higher oriented perforating gun fails to detonate, the firing head associated with the lower oriented gun may be detonated. However, with this configuration, the safety issue is adversely affected. Since each perforating gun now has its own firing head, the gun string, including the firing heads, must be assembled at the surface of the borehole prior to lowering the perforating apparatus into the borehole. If one firing head accidentally detonates, an unwanted detonation of the perforating apparatus may occur. In particular, a detonation wave originating from a lower oriented perforating gun of the modular perforating apparatus may propagate in two directions, that is, in a downward direction and in an upward direction. A detonation wave which originates from the lower oriented perforating gun and which propagates within the detonating cord in the upward direction is known as a backfired detonation wave. A back-fired detonation wave originating from the lower-oriented perforating gun may cause an unwanted detonation of a higher-oriented perforating gun of the modular perforating apparatus. Consequently, for safety reasons, an apparatus is needed, which is adapted to be interconnected between adjacent perforating guns of the modular perforating apparatus, for preventing a back-fired detonation wave originating from the lower-oriented perforating gun from detonating the higher-oriented perforating guns of the modular perforating apparatus.

SUMMARY OF THE INVENTION

Accordingly, it is a primary object of the present invention to provide an explosive diode transfer system adapted to be connected between adjacent perforating guns of a modular perforating apparatus for preventing a back fired detonation wave from a lower oriented gun of the perforating apparatus from detonating a higher oriented gun in the perforating apparatus.

It is a further object of the present invention to provide an explosive diode transfer system including a multi-density barrier, a detonation wave being prevented from propagating through the barrier in one direction but a jet being allowed to propagate through the barrier in an opposite direction.

It is a further object of the present invention to provide the explosive diode transfer system including the multi-density barrier, which barrier includes a first metal layer and a second metal layer spaced from the first metal layer thereby defining a sealed air-space between the first and second metal layers, the two metal layers and the intervening sealed air space representing a plurality of different density layers designed to reflect and attenuate a detonation wave propagating therethrough in one direction but designed to allow the passage of a jet propagating therethrough in an opposite direction.

In accordance with these and other objects of the present invention, an explosive diode transfer system is interconnected between adjacent perforating guns of a modular perforating apparatus. The explosive diode transfer system includes a downwardly directed shaped charge, a booster, and a multi-density barrier interposed between the shaped charge and the booster. The multi-density barrier includes a first metal layer and a second metal layer spaced from the first metal layer thereby defining a sealed air-space between the first and second metal layers. The first metal layer, sealed air space, second metal layer combination represents a plurality of different density barriers or layers which are collectively designed to prevent a first detonation wave, propagating from the booster to the shaped charge, from propagating therethrough, but nevertheless to allow a jet, propagating from the shaped charge to the booster, to propagate therethrough. The multi-density character of the barrier reflects and therefore completely attenuates the first detonation wave as it propagates from the booster to the shaped charge, but does not significantly attenuate the jet propagating from the shaped charge to the booster. Therefore, the multi-density barrier functions like a diode, allowing propagation in one direction, but not allowing propagation in the opposite direction. Consequently, the multi-density barrier explosive diode transfer system of the present invention prevents a back fired detonation wave originating from a lower oriented perforating gun from detonating a higher oriented perforating gun in the modular perforating apparatus.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein.

Figure 1:
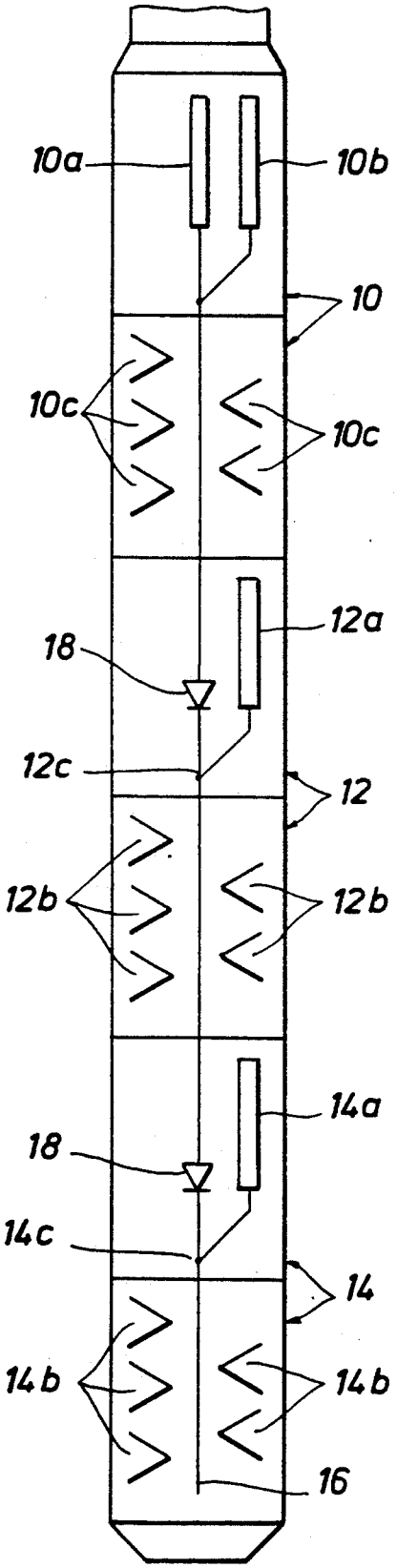
FIG. 1 illustrates a modular perforating apparatus including a plurality of serially connected perforating guns, each having its own firing head, the lowermost perforating guns of the modular perforating apparatus each having their own explosive diode transfer system in accordance with the present invention.
Figure 3:
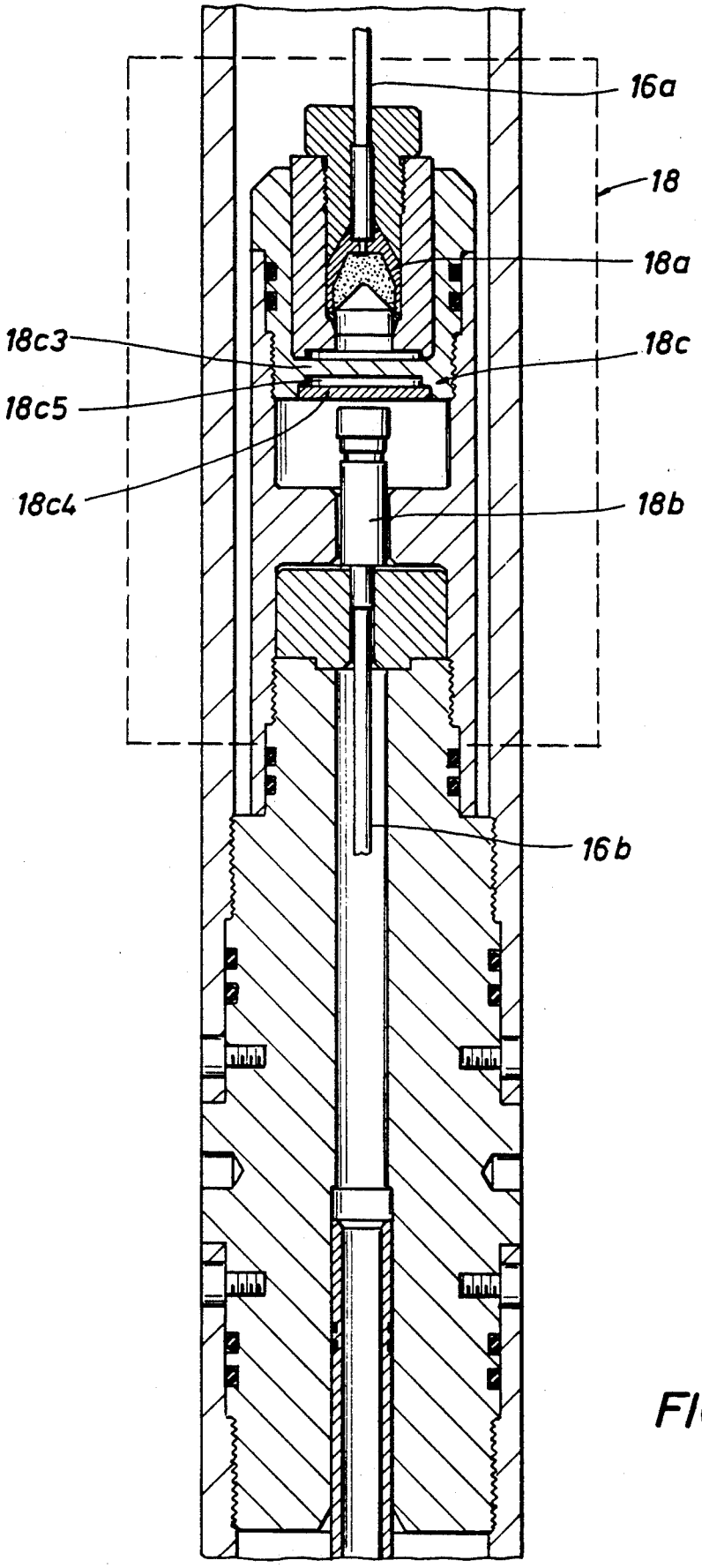
Figure 4:
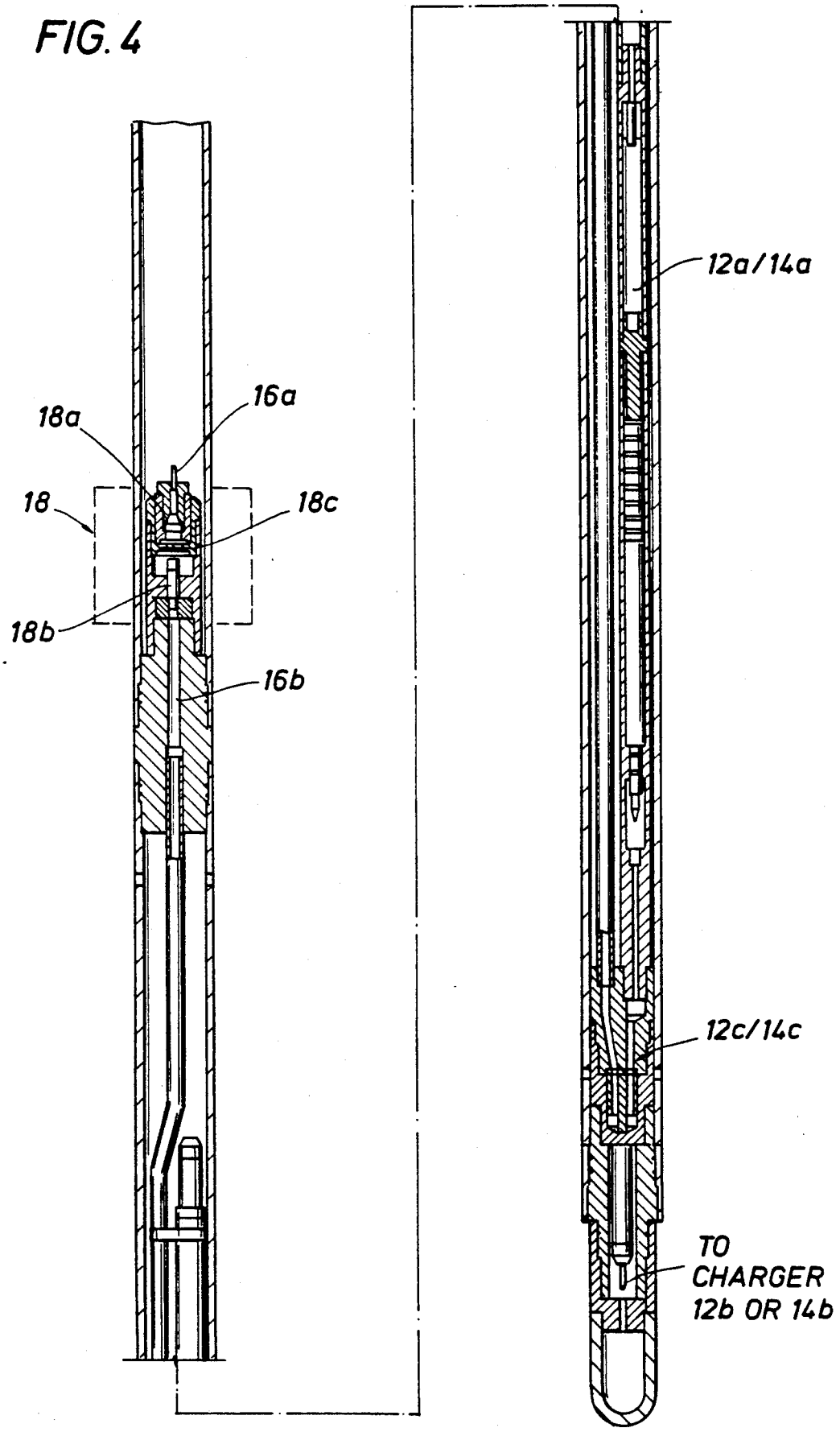

FIGS. *2a–2c* illustrate the explosive diode transfer system of the present invention and the effect of a forward fired and a back fired detonation wave on the explosive diode transfer system;

FIG. 3 illustrates a more detailed construction of the explosive diode transfer system of FIGS. *2a–2c;* and FIG. 4 illustrates another more detailed construction of the modular perforating apparatus of FIG. 1 including the explosive diode transfer system of FIGS. *2a–3*.

DETAILED DESCRIPTION OF THE PREFERRED EMBODIMENT

Referring to FIG. 1, a modular perforating apparatus is illustrated.

In FIG. 1, the modular perforating apparatus includes a first higher oriented perforating gun 10, a second lower oriented perforating gun 12 serially connected to the first gun 10, and a third lower oriented perforating gun 14 serially connected to the second gun 12. A detonating cord 16 is disposed through each of the perforating guns 10, 12, 14. The first perforating gun 10 includes two redundant firing heads 10*a* and 10*b* connected in parallel and a plurality of charges 10*c* connected to detonating cord 16. If one of the firing heads 10*a* or 10*b* fail to detonate, the other firing head may be detonated. The second perforating gun 12 includes a firing head 12*a* and a plurality of charges 12*b* connected to detonating cord 16. The third perforating gun 14 includes a firing head 14*a* and a plurality of charges 14*b* connected to the detonating cord 16. In operation, if a detonation wave is initiated in detonating cord 16 from either firing head 10*a* or 10*b*, it will detonate charges 10*c*, 12*b*, and 14*b* in sequence. If firing head 12*a* initiates a detonation wave in detonating cord 16, charges 12*b* and 14*b* will detonate in sequence. If firing head 14*a* initiates a detonation wave in detonating cord 16, charges 14*b* will detonate.

However, if firing heads 10*a*, 10*b*, and 12*a* have failed to detonate, and when firing head 14*a* initiates a detonation wave in detonating cord 16, the detonation wave will propagate downwardly to detonate charges 14*b*, but it will also attempt to propagate upwardly in the detonating cord 16 to detonate charges 12*b* and 10*c*. If the detonation wave propagates upwardly in the detonating cord 16 of FIG. 1, it is called a "back fired" detonation wave. If the detonation wave propagates downwardly in the detonating cord 16 of FIG. 1, it is called a "forward fired" detonation wave. The modular perforating apparatus of FIG. 1 is assembled and armed at the surface of a wellbore; and a firing head is connected to each perforating gun of the modular perforating apparatus in order to improve the reliability of detonation of the perforating apparatus when the apparatus is disposed downhole in the wellbore. However, since the perforating apparatus is assembled and armed at the surface of the wellbore, if the back fired detonation wave is allowed to propagate upwardly in the detonating cord 16, a safety hazard is created. In order to eliminate the safety hazard, it is desirable to prevent the back fired detonation wave from propagating upwardly in the detonating cord 16.

Therefore, in order to prevent the back fired detonation wave originating from firing head 14*a* from propagating upwardly in the detonating cord 16 and detonating charges 12*b* and 10*c*, in accordance with the present invention, each of the lower oriented first and second perforating guns 12 and 14 include an explosive diode transfer system 18 connected in series along the detonating cord 16. The explosive diode transfer system 18 functions like a diode; it will allow a jet to pass through the explosive diode 18 in one direction, but it will not allow a detonation wave to pass through the explosive diode 18 in an opposite direction. In FIG. 1, the explosive diode transfer system 18 allows a jet and/or detonation wave to propagate downwardly in the detonating cord 16 but it does not allow a detonation wave to propagate upwardly in the detonating cord 16. As a result, the detonation wave in cord 16 initiated by firing head 14*a* can propagate downwardly to detonate charges 14*b*, but it cannot propagate upwardly through explosive diode 18; thus, it cannot detonate charges 12*b* or 10*c*. The safety hazard is eliminated. Similarly, the detonation wave in cord 16 initiated by firing head 12*a* can propagate downwardly to detonate charges 12*b* and 14*b*, but it cannot propagate upwardly through explosive diode 18; thus, it cannot detonate charges 10*c*.

Referring to FIGS. *2a–2c*, the explosive diode transfer system 18 of the present invention is illustrated. In addition, the effect, on the explosive diode transfer system 18, of a forward fired and a back fired detonation wave is illustrated.

In FIG. *2a*, the explosive diode transfer system 18 is illustrated in its condition which exists prior to the passage therethrough of a detonation wave, such condition being hereinafter termed the "no fire" condition. The detonating cord 16 includes a first cord 16*a* disposed on a top part of the system 18 and a second cord 16*b* disposed on a bottom part of system 18. A downwardly directed shaped charge 18*a* (also termed a "trigger charge" 18*a*) is connected to an end of the first cord 16*a*. A booster 18*b* is connected to an end of the second cord 16*b*, the trigger charge 18*a* being disposed adjacent the booster 18*b* so that a jet from charge 18*a* will ignite booster 18*b*. A multidensity barrier 18*c* is disposed between the trigger charge 18*a* and the booster 18*b*. The multidensity barrier 18*c* will be discussed in more detail below with reference to FIG. 3 of the drawings; however, it is important to understand at the outset that the multidensity characteristic of the barrier 18*c* is responsible for reflecting and completely attenuating a back fired detonation wave passing through the barrier 18*c*, but the multidensity characteristic of the barrier 18*c* does not reflect or attenuate, to any significant extent, a forward fired jet from the trigger charge 18*a* passing through the barrier 18*c*. In operation, a forward fired detonation wave normally propagates down the first cord 16*a* to the trigger charge 18*a* thereby detonating the trigger charge 18*a*. A jet from the trigger charge 18*a* propagates through the multidensity barrier 18*c* thereby igniting the booster 18*b* and initiating the propagation of another detonation wave in the second cord 16*b*, the said another detonation wave propagating down the second cord 16b. However, if a back fired detonation wave propagates up the second cord 16b to the booster 18b (before a forward fired detonation wave propagates down the first cord 16a to trigger charge 18a), the booster 18b detonates. In this case, the multidensity characteristic of the barrier 18c reflects and completely attenuates the back fired detonation wave attempting to pass through the barrier 18c and therefore prevents the back fired wave from reaching the trigger charge 18a. As a result, the back fired detonation wave fails to propagate up the first cord 16a.

Figure 2A:
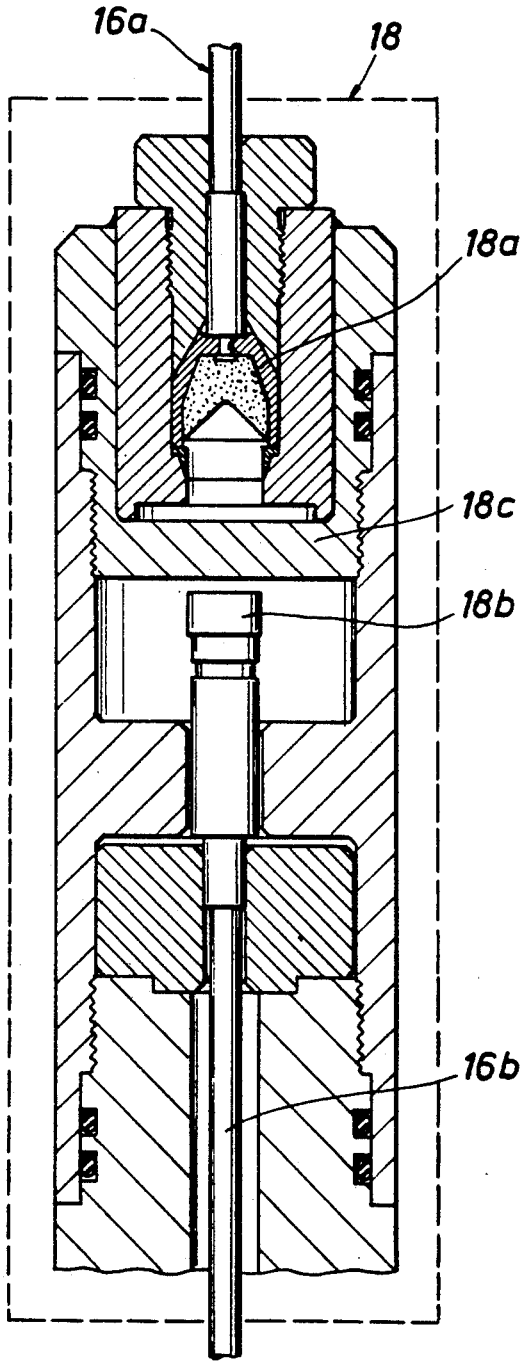

In FIG. 2a, the explosive diode transfer system 18 is illustrated in its "no fire" condition. A detonation wave has not yet transferred through the system 18. Therefore, the multidensity barrier 18c is intact and has not been deformed or otherwise distorted.

Figure 2B:
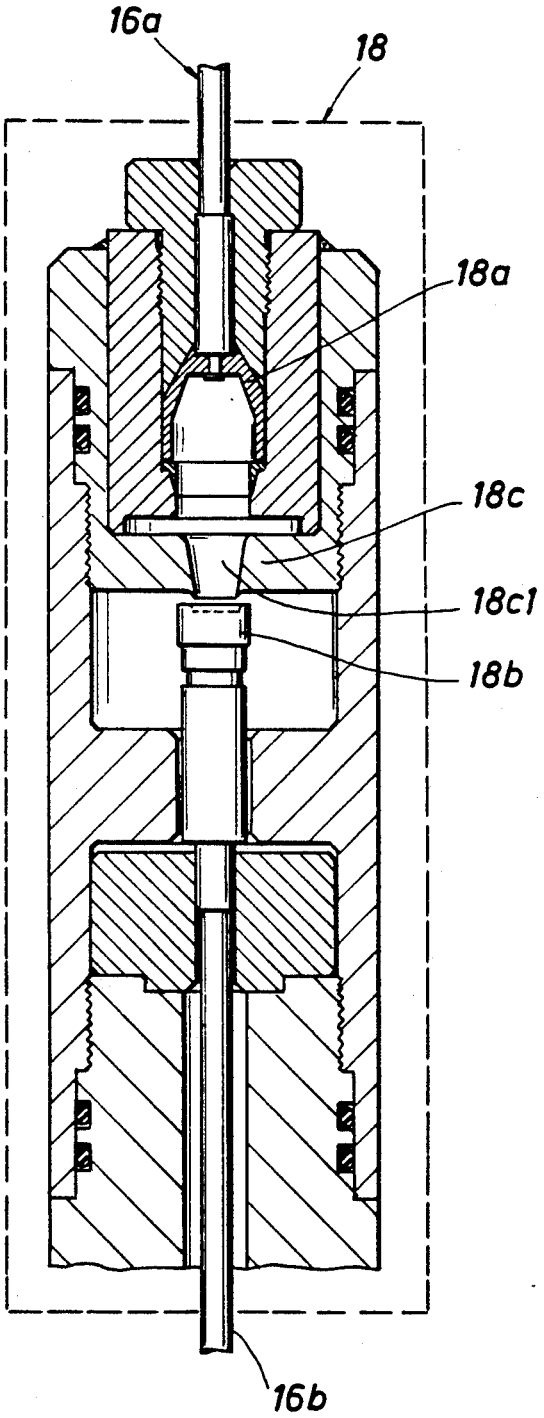

In FIG. 2b, the explosive diode transfer system 18 is illustrated in its "forward firing" condition. A forward fired jet has transferred from trigger charge 18a to booster 18b. The multidensity barrier 18c has a hole 18c1 disposed therethrough illustrating the location in the barrier 18c where the jet from the trigger charge 18a has transferred to booster 18b.

Figure 2C:
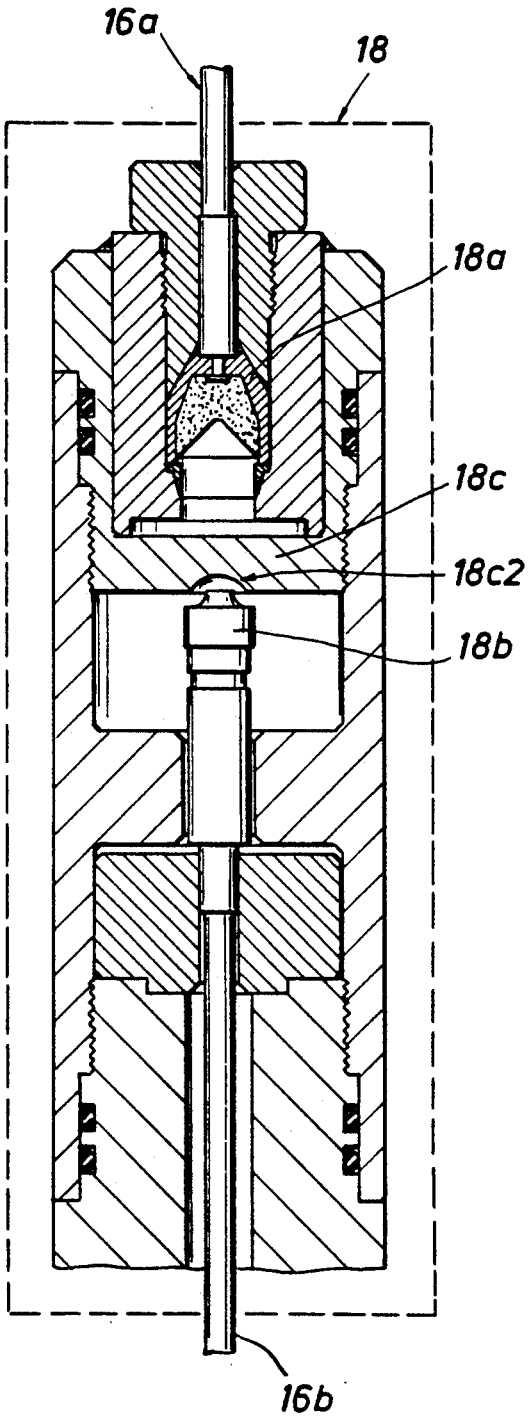

In FIG. 2c, the explosive diode transfer system 18 is illustrated in its "back fired" condition. A back fired detonation wave has attempted to transfer from booster 18b to trigger charge 18a. The multidensity barrier 18c includes a dent 18c2 illustrating the location in the barrier 18c where a detonation of booster 18b (in response to a back fired detonation wave) has attempted to pass through the barrier 18c to trigger charge 18a. Note that the barrier 18c has successfully blocked the transfer of the back fired detonation wave from booster 18b to trigger charge 18a.

Referring to FIG. 3, a more detailed construction of the explosive diode transfer system 18 of FIGS. 2a–2c is illustrated, and in particular, the structure of the explosive diode transfer system which produces the multidensity characteristic of the multidensity barrier 18c is illustrated.

In FIG. 3, the explosive diode transfer system 18 of FIGS. 2a–2c is again illustrated; however, the multidensity barrier 18c comprises a first metal layer 18c3, a second metal layer 18c4 spaced from the first metal layer 18c3, and an air space 18c5 disposed between the first metal layer 18c3 and the second metal layer 18c4, the air space 18c5 being a sealed air space and being pressure tight. The first and second metal layers 18c3 and 18c4 are each comprised of an alloy steel (AISI 4140 COM H. T.). The three layers which comprise the multidensity barrier 18c (the second metal layer 18c4, the air space 18c5, and the first metal layer 18c3) represent different density sub-barriers. The different densities of the three sub-barriers assist in reflecting and attenuating the back fired detonation wave attempting to pass from booster 18b to trigger charge 19a. However, the most important structural characteristic of the multidensity barrier 18c is the air space 18c5 disposed between the two other metal layers 18c3 and 18c4. Without the air space 18c5, the back fired detonation wave would be partially reflected at the first metal layer 18c4/second metal layer 18c3 interface; however, the remainder of the back fired detonation wave which is not reflected at the interface would propagate through the first metal layer 18c3 to trigger charge 18a. On the other hand, the air space 18c5 disposed between the two metal layers prevents the remainder of the back fired detonation wave, originating from the second metal layer 18c4, from reaching the first metal layer 18c3 or at least from propagating through the first metal layer 18c3 to trigger charge 18a.

The attenuation of the detonation wave propagating in the upward direction in FIG. 3 is affected by the two plates of steel 18c3 and 18c4 separated by the sealed air space 18c5. This attenuation is caused by the difference in detonation impedence between the two steel plate materials. The detonation impedence is a function of the detonation velocity of the detonation wave and the density of the steel plate materials. The greater the difference in detonation impedence between the two steel plate materials, the greater the attenuation. In addition, the greater the number of interfaces (e.g., plate to air space interface, air space to plate interface), the greater the attenuation. Furthermore, the air space 18c5 of multidensity barrier 18c remains sealed even though a perforating gun disposed immediately below the barrier 18c in the gun string has detonated; as a result, the sealed barrier prevents flooding of a perforating gun disposed immediately above the barrier.

Referring to FIG. 4, another more detailed construction of the modular perforating apparatus of FIG. 1, including the explosive diode transfer system 18 of FIGS. 2a–3, is illustrated.

In FIG. 4, a more realistic embodiment of the modular perforating apparatus of FIG. 1 comprises a detonating cord including the first cord 16a and the second cord 16b, the explosive diode transfer system 18 interconnected between the first cord and second cord, as shown in FIGS. 2a–3, and a firing head 12a/14a. Note that the second cord 16b bypasses the firing head 12a/14a, the second cord 16b merging with the firing head 12a/14a at a junction 12c/14c. Note the location of the junctions 12c and 14c in FIG. 1. A further detonating cord at junction 12c/14c extends to the charges 12b or 14b of FIG. 1.

A functional description of the explosive diode transfer system of the present invention will be set forth in the following paragraphs with reference to FIGS. 1–4 of the drawings.

Each of the firing heads 10a, 10b, 12a, and 14a function as follows: first, the firing head is actuated; and second, following the expiration of a predetermined time period after actuation, detonation of the firing head occurs; the predetermined time period being called a "time delay". Firing heads 10a and 10b each have approximately the same time delay. However, the time delay associated with firing head 12a is greater than the time delay associated with firing heads 10a/10b, and the time delay associated with firing head 14a is greater than the time delay associated with firing head 12a.

In operation, firing heads 10a, 10b, 12a and 14a are all actuated approximately simultaneously. Following actuation of firing heads 10a/10b, and when a first time delay has elapsed, the firing heads 10a and 10b detonate. Firing head 12a will detonate after a predetermined time period following detonation of firing heads 10a/10b, and firing head 14a will detonate after a predetermined time period following detonation of the firing head 12a.

However, if firing heads 10a and 10b fail to detonate, firing head 12a may be detonated for subsequently detonating charges 12b and 14b. On the other hand, if firing heads 10a, 10b, and 12a all fail to detonate, firing head 14a may be detonated for detonating charges 14b.

During normal operation, since the firing heads 10a and 10b are the first to detonate, the firing heads 10a and 10*b* initiate the propagation of a detonation wave in detonating cord 16 thereby sequentially detonating charges 10*c*, 12*b*, and 14*b*. When the detonation wave arrives at the first explosive diode transfer system 18 via first cord 16*a*, as shown in FIG. 2*b*, the trigger charge 18*a* will produce a jet which punctures a hole 18*c*1 in multidensity barrier 18*c*, igniting the booster 18*b*, and propagating another detonation wave down the second cord 16*b* to charges 12*b* and eventually to charges 14*b*.

However, during abnormal operation, if firing heads 10*a* and 10*b* fail to detonate, firing head 12*a* is required to detonate charges 12*b* and 14*b*. The firing head 12*a* will initiate the propagation of a detonation wave in detonating cord 16 thereby detonating charges 12*b* and 14*b*. However, the detonation wave will also attempt to propagate upwardly in detonating cord 16 in an attempt to detonate charges 10*c*.

On the other hand, if firing heads 10*a*, 10*b*, and 12*a* fail to detonate, firing head 14*a* is required to detonate charges 14*b*. The firing head 14*a* will initiate the propagation of a detonation wave in detonating cord 16 thereby detonating charges 14*b*. However, the detonation wave will also attempt to propagate upwardly in detonating cord 16 in an attempt to detonate charges 12*b* and 10*c*.

The detonation wave which propagates upwardly is called a back fired detonation wave. This back fired detonation wave will arrive at booster 18*b* via second cord 16*b* of the explosive diode transfer system 18 of FIG. 2*c*. The multidensity barrier 18*c* will block the upwardly directed propagation of the back fired detonation wave, as evidenced by the dent 18*c*2 in FIG. 2*c*. To be more specific, as noted in FIG. 3, the back fired detonation wave propagating in second cord 16*b* ignites and detonates booster 18*b*. The detonation of booster 18*b* impacts the second metallic layer 18*c*4 of the multidensity barrier 18*c*. An explosive train propagates through the second layer 18*c*4 and into the sealed air space 18*c*5 of multidensity barrier 18*c*. However, due to the different densities of metal layer 18*c*4, air space 18*c*5, and metal layer 18*c*3, the explosive train is reflected and attenuated as it propagates through the second metal layer 18*c*4 and through air space 18*c*5. Since the explosive train is reflected and attenuated in metal layer 18*c*4 and air space 18*c*5, very little, if any, explosive train impacts the first metal layer 18*c*3 of the multidensity barrier 18*c*. Therefore, the explosive train fails to exit from the other side of first metallic layer 18*c*3 and fails to detonate the trigger charge 18*a*. As a result, the propagation of the back fired detonation wave is completely blocked by the multidensity barrier 18*c* of the explosive diode transfer system 18; the charges 10*c* are not detonated if firing heads 10*a* and 10*b* fail; the charges 12*b* and 10*c* are not detonated if firing heads 10*a*, 10*b*, 12*a* fail.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. Apparatus adapted to be interconnected between a first detonating cord and a second detonating cord, comprising: means for allowing a forward detonation wave propagating in said first detonating card in one direction to propagate in said second detonating cord but preventing a back fired detonation wave propagating in said second detonating cord in a direction opposite to said one direction from propagating in said first detonating cord, said means including, a first layer having a first density and a first detonation impedance, and a second layer spaced from said first layer and defining a sealed air space between said first layer and said second layer, said second layer having a second density and a second detonation impedance, the second density of said second layer being different than the first density of said first layer, the different densities of the first and second layers producing a difference in the detonation impedance between the first and second layers.

2. The apparatus of claim 1, wherein the first and second layers are comprised of alloy steel, the density of the alloy steel of the first layer being different than the density of the alloy steel of the second layer.

3. Apparatus adapted to be interconnected between a first detonating cord and a second detonating cord, comprising:

multidensity barrier means adapted to be connected between the first detonating cord and the second detonating cord for allowing a first detonation wave propagating in said first detonating cord in one direction to propagate in said second detonating cord but preventing a second detonation wave propagating in said second detonating cord in a direction opposite to said one direction from propagating in said first detonating cord, said multidensity barrier means including, a first layer having a first density, and a second layer spaced from said first layer and defining a sealed air space between said first layer and said second layer, said second layer having a second density, the second density of said second layer being different than the first density of said first layer, the different densities of the first and second layers producing a difference in detonation impedance between the first and second layers.

4. The apparatus of claim 3, wherein the first and second layers are comprised of alloy steel, the density of the alloy steel of the first layer being different than the density of the alloy steel of the second layer.

5. A transfer system adapted for transferring a detonation wave from a first detonating cord to a second detonating cord, comprising:

a multidensity barrier adapted to be connected between said first detonating cord and said second detonating cord, said multidensity barrier including, a first layer having a first density, and a second layer spaced from said first layer and defining a seal air space between said first layer and said second layer, said second layer having a second density, the second density of said second layer being different than the first density of said first layer, the different densities of the first and second layers producing a difference in detonation impedance between the first and second layers.

6. The transfer system of claim 5, wherein the first and second layers are comprised of alloy steel, the density of the alloy steel of the first layer being different than the density of the alloy steel of the second layer.

7. The transfer system of claim 5, wherein said multidensity barrier allows a first detonation wave to transfer from said first detonating cord to said second detonating cord but prevents a second detonation wave from transferring from said second detonating cord to said first detonating cord.

* * * * *